US006761113B2

(12) United States Patent
Korthäuer

(10) Patent No.: US 6,761,113 B2
(45) Date of Patent: Jul. 13, 2004

(54) LABEL PRINTER

(75) Inventor: Manfred Korthäuer, Mülheim/Ruhr (DE)

(73) Assignee: Espera Werke GmbH, Duisburg (DE)

( * ) Notice: Subject to any disclaimer, the term of this patent is extended or adjusted under 35 U.S.C. 154(b) by 0 days.

(21) Appl. No.: 10/275,594

(22) PCT Filed: Mar. 29, 2001

(86) PCT No.: PCT/EP01/03569

§ 371 (c)(1),
(2), (4) Date: Nov. 6, 2002

(87) PCT Pub. No.: WO01/85548

PCT Pub. Date: Nov. 15, 2001

(65) Prior Publication Data

US 2003/0140804 A1 Jul. 31, 2003

(30) Foreign Application Priority Data

May 8, 2000 (DE) ..... 100 22 152

(51) Int. Cl.[7] ..... B41F 13/54

(52) U.S. Cl. ..... 101/288; 101/227; 101/66; 101/348; 101/349

(58) Field of Search ..... 101/288, 227, 101/66, 348, 349

(56) References Cited

U.S. PATENT DOCUMENTS 3,997,384 A * 12/1976 Kuring et al. ..... 156/269
4,440,592 A * 4/1984 Sato et al. ..... 156/384
4,768,435 A * 9/1988 Nimura et al. ..... 101/66
4,823,694 A * 4/1989 Siegenthaler ..... 101/227
5,674,345 A 10/1997 Nash
5,967,040 A 10/1999 Korthäuer et al.
6,145,436 A 11/2000 Natalizia et al.
6,568,451 B1 * 5/2003 Korthauer ..... 156/540

FOREIGN PATENT DOCUMENTS

| | | |
|---|---|---|
| DE | 25 50 090 A1 | 2/1977 |
| EP | 0 952 086 A1 | 10/1999 |
| FR | 1541452 | 10/1968 |
| JP | 09 110 026 A | 4/1997 |

* cited by examiner

*Primary Examiner*—Ren Yan
*Assistant Examiner*—Andrea H. Evans
(74) *Attorney, Agent, or Firm*—Proskauer Rose LLP

(57) ABSTRACT

The invention relates to a printing device for printing labels which have been removably affixed to a carrier strip, in particular goods labels, comprising at least one label feed device which comprises at least one wiper head, as well as comprising at least one printer with at least one print head for printing the label. Different label models can be printed in a continuous labelling process using only one printer, if at least one conveyor device is provided which conveys the labels, which have been peeled off at a wiper head, of which there is at least one, to the printer, of which there is at least one.

14 Claims, 2 Drawing Sheets

LABEL PRINTER

BACKGROUND OF THE INVENTION

The invention relates to a printing device for printing labels which have been removably affixed to a carrier strip, in particular goods labels, comprising at least one label feed device which comprises at least one wiper head, as well as comprising at least one printer with at least one print head for printing the label.

A printing device of this type is known from the state of the art. For example, a portable labelling device for affixing and delaminating printed labels is known from DE 32 16 258 A1. In this labelling device, the labels are arranged one behind the other on a carrier belt.

Furthermore, from U.S. Pat. No. 3,997,384, a device comprising a multitude of permanent label feed devices is known.

Such known printing devices are associated with a disadvantage in that, when a different label model is required, e.g., involving a different color, graphic design or text, it becomes necessary to manually exchange the carrier strip with the labels (ticket roll, tape of flat folded labels sold under the trademark LIPORELLO™). This precludes operation using a variety of labels. If during a labeling process, different label types are required, in particular if the choice of model only results from parameters obtained immediately prior to printing, as may for example be the case where there is a combination of a printer and a weighing device, such labelling devices cannot be used.

It is desirable that labelling can be carried out with various label models.

In this context it must be borne in mind that the goods to be labelled are acquired by means of an automatic pattern recognition device, and depending on the object to be labelled, one of many different labels is selected. However, there may also be a need for weight-dependent or piece-number-dependent printing and labelling or labelling based on input by an operator or by a computer system.

With known labelling devices, in the most unfavourable case, the ticket roll has to be exchanged between each label. This makes economical labelling quite impossible.

From U.S. Pat. No. 4,768,435, an option is known which ensures uninterrupted operation. This printed publication proposes the use of two printers for printing two different models. Since a printer accounts for a significant part of the expense of a labelling device and also takes up additional room, such a device becomes considerably more expensive as the number of different label models increases.

EP 0 309 659 and EP 0 362 976 describe a device for printing several models without the need to change the model roll. These devices make do with a single printer. It is proposed that pieces of paper be printed which after completion of the printing process are cut off. In this way it is possible to advance the beginning of a selected paper supply roll, lead it to the printer, cut it off, and after completion of the printing process push the free beginning back again, before selecting the beginning of another supply roll.

However, such a process is not possible if instead of paper pieces, self-adhesive labels affixed to a carrier strip are to be printed. This is because after printing and removing a label, the label-free carrier strip remains and has to be accommodated again. In addition, the carrier strip must be kept taut so as to ensure good quality label printing.

SUMMARY OF THE INVENTION

It is thus the object of the invention to be able to print different label models in a continuous labelling process, using at least one printer.

According to the invention, the object derived and explained above is met in that a conveyor device is provided which conveys to a printer the label which has been peeled off at the wiper head. The labels, which depending on particular requirements are peeled off at the wiper heads or wiper edges by the respective label feed devices, are conveyed to the printer. Said printer can then print the labels as specified by a control system. The printed labels are then affixed to the goods by means of a labelling device. A multitude of label feed devices can be arranged along the conveyor device. The maximum number of label feed devices is determined by the size of the conveyor device as well as by the time allowed for label feed from the wiper head to the printer. The label which is peeled off from that wiper head which is located the largest distance away from the print head, must be able to be conveyed to the printer within the permitted time span. The conveyor device according to the invention makes it possible to mix and print the labels of the various label feed devices at will.

By using at least one conveyor device which comprises at least one label transfer station, said conveyor device, of which there is at leat one, conveying the labels peeled off at the wiper head of which there is at least one, to the printer of which there is at least one, wherein at first a first conveyor device conveys the label peeled off from the carrier strip and transfers the peeled-off label at least once at the label transfer station to the same first conveyor device or to a further conveyor device, the label to be printed can be conveyed even along substantial distances. The use of the same type of conveyor device, or of different types of conveyor devices, is possible.

It is also possible to provide at least two different conveyor devices which convey the label peeled off at the wiper head, of which there is at least one, to the printer, of which there is at least one, wherein at first the first conveyor device conveys the label and then the second conveyor device conveys the label. The use of different conveyor devices makes it possible to flexibly arrange the printing device and to adapt it to the particular circumstances of the available space and the process technology used.

A printing device is proposed in which the conveyor device, of which there is at least one, is a conveyor belt, and in which the conveyor belt conveys the peeled-off labels to the printer, of which there is at least one. The conveyor belt can be any of the following: an elastic belt, a plate belt, a chain or any other belt which essentially is tensioned between at least two rotating cylinders which are arranged so as to be axially parallel to each other. The labels can be quickly conveyed to the printer by way of the conveyor belt. Immediately after the printing process, the conveyor belt can convey the printed label to a labelling device.

The necessary design space can be limited by using a conveying roller which conveys the peeled-off labels to the printer, of which there is at least one. If a conveying roller is used, the printed labels can also be fed to a labelling device directly after the printing process. In this arrangement, the conveying roller may be a conveyor drum.

The conveyor device, of which there is at least one, can be a plate, with the plate carrying out either a rotary movement or an oscillating movement. In the case of a rotary plate, the label feed devices are arranged along a radius of the plate. In this way, the rotary movement causes the peeled-off labels to be conveyed to a printer, of which there is at least one, which printer is arranged at the same radius of the plate. A plate which essentially oscillates along the horizontal axis, first moves to the label feed device which requires the next label, picks this label up at the wiper head and then moves to the printer. At the printer, the label is printed. After the label has been printed, it must be removed from the plate by a gripper arm and must be conveyed to a labelling device.

The printed labels are taken up by at least one labelling device and are affixed to the product. The labelling device is arranged along the path of conveyance of the objects to be labelled and takes up the labels which have been printed by the printer, of which there is at least one. After the labels have been taken up, they are placed onto the objects to be labelled and are affixed.

A particularly simple and reliable option of feeding the carrier strips to the wiper heads, results from an embodiment of the printing device according to the invention in which the label feed device, of which there is at least one, comprises a take-off reel for unrolling a ticket roll comprising the carrier strip and the labels which have been removably affixed to said carrier strip, and comprises a take-up reel for taking up the carrier strip from which the labels have been removed. Such a variant of an embodiment also allows taught guidance of the carrier strips over the wiper heads or the wiper edges, so that they always rest flat and in straight alignment on the conveyor device, and thus can always be printed neatly by the printer.

It is also possible to use a label feed device, of which there is at least one, which comprises a supply device for accommodating LIPORELLO™ tapes comprising the carrier strip and the labels which have been removably affixed thereto, and which comprises a take-up device for taking up the carrier strip from which the labels have been removed. In this way, it is also possible to use LIPORELLO™ labels arranged on a folded carrier belt. The supply device can be a LIPORELLO™ storehouse.

It is very easy to dispose of the carrier strips from which the labels have been removed, if the label feed device, of which there is at least one, comprises a take-up device for taking up the carrier strip from which the labels have been removed, wherein the take-up device comminutes the carrier strip from which the labels have been removed. In this way, simultaneous or independent compressing, folding and/or intermediate storing is also possible.

Preferably the printer, of which there is at least one, is a thermal printer in which the thermal strip prints the temperature-sensitive labels by applying heat locally. However, the printer can also be based on a thermotransfer, ink-jet, matrix or laser printing process.

According to one embodiment, both the printer and the label feed devices are essentially arranged so as to be stationary. Stationary arrangement of printer and label feed device results in reduced wear of the machine.

The use of various printers in one stationary location, or alternatively of one printer in various locations, can be realised in that the printer, of which there is at least one, is arranged so as to be slidable along an axis. For example an arrangement of the printer on a boom is imaginable in this context. This is for example advantageous in the case of colour printing involving several colours.

The wiper heads or wiper edges, of which there are at least two, are preferably arranged along one line. When using a conveying roller as well as a conveyor plate which carries out a rotary movement, the wiper heads, of which there are at least two, are alternatively arranged essentially along a reference circle path or a curved path.

If at least part of the label feed device is arranged so as to be slidable essentially perpendicularly to the direction of conveyance of the conveyor device, changing the ticket roll can take place without interrupting the printing process on the remaining ticket rolls. To this effect, the label feed device which contains the ticket roll to be changed, is lifted from the conveyor device, and the ticket roll to be changed can be changed. Either the entire label feed device or only the wiper head or the wiper edge can be lifted. Meanwhile the printing process involving the remaining ticket rolls can be carried out without any interruption. This enables uninterrupted labelling for any duration, since after using up the last label of a ticket roll or ticket cassette, a changeover to a further roll or cassette can be made. While labelling with the use of the currently required ticket roll or ticket cassette is in progress, new labels can be placed in the empty ticket roll or ticket cassette, without hindering operations.

BRIEF DESCRIPTION OF THE DRAWINGS

Below, the printing device according to the invention is shown by means of drawings depicting exemplary embodiments. The following are shown.

DETAILED DESCRIPTION OF THE INVENTION

Figure 1:
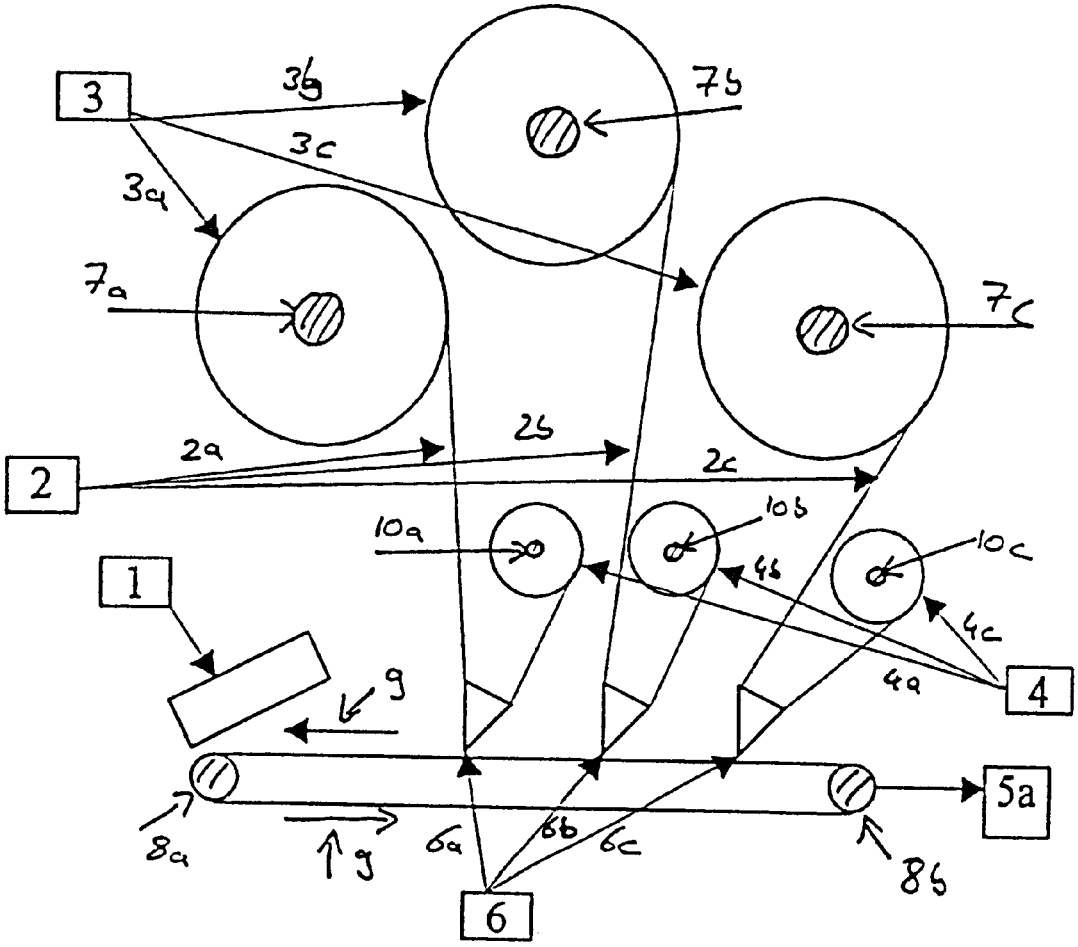
FIG. 1 a printing device according to the invention, involving a conveyor belt.

The printing device shown in FIG. 1 comprises a printer 1, which is arranged at the end of a conveyor belt 5*a* which is guided by way of rollers 8*a*, 8*b* and moves along a direction of movement 9. Instead of a single printer 1, several printers may be used. Each of the label feed devices arranged along the conveyor belt 5*a*, comprises a take-off reel 7*a*, 7*b*, 7*c*, a wiper head 6*a*, 6*b*, 6*c*, and a take-up reel 10*a*, 10*b*, 10*c*.

Each of the label feed devices is equipped with a ticket roll 3*a*, 3*b*, 3*c* and the ticket roll 3*a*, 3*b*, 3*c* is suspended from the take-off reel 7*a*, 7*b*, 7*c*. The carrier strip 2*a*, 2*b*, 2*c* is guided over the wiper head 6*a*, 6*b*, 6*c* to the take-up reel 10*a*, 10*b*, 10*c*. The carrier strip 2*a*, 2*b*, 2*c* bears labels which have been removably affixed to it. At the wiper heads 6*a*, 6*b*, 6*c*, these labels are peeled off from the carrier strip 2*a*, 2*b*, 2*c*, and only the carrier strip 4*a*, 4*b*, 4*c* remains which is taken up by the take-up reels 10*a*, 10*b*, 10*c*.

The label feed devices 7, 6, 10, can be arranged so as to be perpendicular in relation to the direction of movement 9 of the conveyor belt 5*a*. By lifting or removing a label feed device 7*a*, 6*a*, 10*a* or alternatively by only lifting the wiper head 6*a*, a used up ticket roll 3*a* can be removed from the reels 7*a*, 10*a* and a new ticket roll 3*a* can be placed on the reels 7*a*, 10*a*. During this procedure, printing continues, with the labels of the remaining ticket rolls 3*b*, 3*c* being used. When the ticket roll 3*a* has been replaced, the label feed device 7*a*, 6*a*, 10*a* or the wiper head 6*a* can be lowered or inserted, and the labels of the new ticket roll 3*a* can now be used.

The printing device shown in FIG. 1 operates as follows: an object to be labelled (not shown) is fed to the printer 1 along a conveyor belt (not shown). A measuring and/or recording system (not shown) has previously measured or recorded the object. Based on these results, the label to be printed is selected and the respective ticket roll 3*a*, 3*b*, 3*c* is unrolled by reels 7, 10. As a result, said label is peeled off at the wiper head 6*a*, 6*b*, 6*c* and then placed on the conveyor belt 5*a*. Subsequently, the peeled-off label is fed to the printer 1 via the conveyor belt 5*a* along the direction of movement 9. It is quite feasible (but not shown) that the label is not conveyed to the printer 1 merely by a single conveyor device, but instead by several conveyor devices which may be different in design, such as conveyor belts, conveying rollers and conveyor plates. Similarly, one or several transfer operations of the label at label transfer stations (not shown) to one or several conveyor devices, either of the same design or of different design, is/are possible. The printer 1 prints the label according to the specifications obtained from the measuring and/or recording system. After the printing process, the label is rolled off the conveyor belt 5*a*, taken up by a labelling device (not shown) and applied to the object. Printing of the label can also take place after transfer of the label, of which transfer there is at least one, from a conveyor belt to e.g. a roller. A device for acquiring the label position may be accommodated in the gap between the conveyor belt and the roller. Acquisition of the exact label position is necessary to be able to print the label with accuracy. Unrolling of the ticket roll 3*a*, 3*b*, 3*c* takes place such that the take-up reel 3*a*, 3*b*, 3*c* is rotated anticlockwise. Rotation of the take-up reel 10*a*, 10*b*, 10*c* causes the carrier strip 2*a*, 2*b*, 2*c* to be guided over the wiper head 6*a*, 6*b*, 6*c*.

Figure 2:
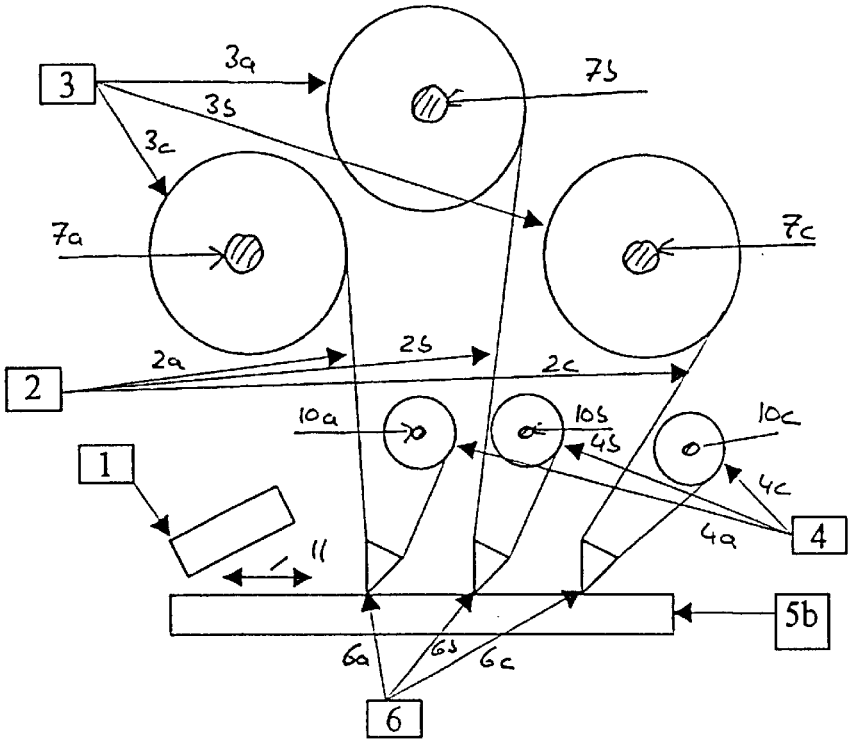
FIG. 2 a printing device according to the invention, comprising an oscillating plate.

The printing device shown in FIG. 2 differs from that shown in FIG. 1 only in that the conveyor device 5*b* is different. The conveyor device 5*b* is an oscillating plate. This oscillating plate moves horizontally, thus conveying the labels peeled off at the wiper head 6*a*, 6*b*, 6*c* to the printer 1 along the direction of movement 11. Here again, more than one conveyor device may convey the labels to the printer 1. Depending on the label to be printed, the plate 5*b* needs to be more or less dislocated. Such dislocation of the plate 5*b* is selected such that during the printing process the label is arranged underneath the printer 1. After the label has been printed by the printer 1, said label has to be lifted off the plate 5*b* by a labelling device (not shown). It can then be applied to an object. This can take place either after the plate has been swung back, or by an additional sideways movement of the labelling device (not shown), past the plate, to the object.

Instead of an oscillating plate 5*b*, the plate 5*b* can also be held so as to be rotatable. In such a case, the wiper heads 6*a*, 6*b*, 6*c* as well as the printer 1 have to be arranged along the same radius of plate 5*b*. The plate 5*b* rotates a peeled-off label to the printer 1. After said label has been printed, it has to be lifted off the plate by a labelling device (not shown).

Figure 3:
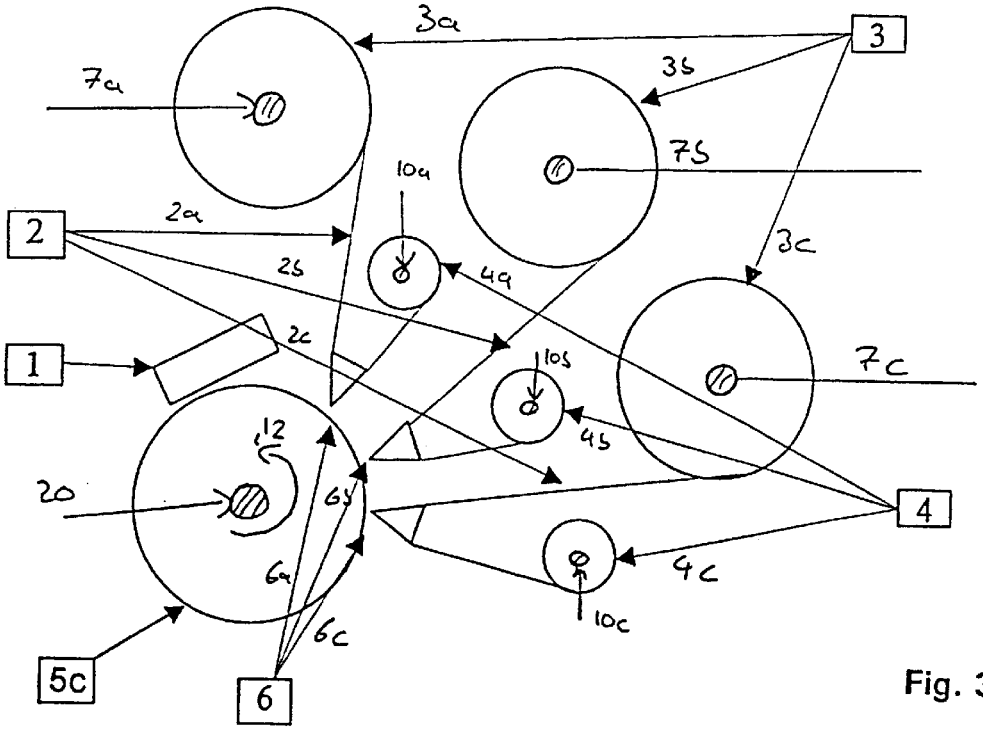
FIG. 3 a printing device according to the invention, comprising a conveying roller.

The printing device shown in FIG. 3 differs from the previously shown printing devices in that the conveyor device comprises a conveying roller 5*c*. The conveying roller 5*c* is held so as to be rotatable on the axis 20. The labels are guided along the direction of rotation 12 by the wiper heads 6*a*, 6*b*, 6*c* through the conveying roller 5*c* to the printer 1. Here again, the use of several conveyor devices is imaginable. After the labels have been printed by the printer 1, they can be taken up directly from the conveying roller 5*c* by a labelling device (not shown) and affixed to the object. Here again, it is possible to lift the label feed device 7, 6, 10 or the wiper head 6, from the conveying roller 5*c*, so as to replace the ticket roll 3.

What is claimed is:

1. A printing device for printing labels which have been removably affixed to a carrier strip comprising:

at least two label feed devices, each label feed device comprising a wiper head; and at least one printer with at least one print head for printing the labels, the printer and the wiper heads of the label feed devices being arranged so as to be simultaneously stationary during the entire normal operation of the printing device, wherein the wiper heads of the label feed devices are allocated to a common conveyor device, which conveys the labels peeled off at the respective wiper heads to the printer.

2. The printing device of claim 1, wherein the printing labels are goods labels.

3. The printing device of claim 1, wherein the conveyor device is a conveyor belt which conveys the peeled-off labels to the printer.

4. The printing device of claim 1, wherein the conveyor device is a conveyor roller which conveys the peeled-off labels to the printer.

5. The printing device of claim 1, wherein the conveyor device is a plate which carries out a rotary movement such that the peeled-off labels are conveyed to the printer.

6. The printing device of claim 1, wherein the conveyor device is a plate carrying out an oscillating movement in a way that the plate at a first point of the oscillating movement takes up the peeled-off labels, and at a second point of the oscillating movement feeds the peeled-off labels to the printer.

7. The printing device of claim 1, wherein one of at least two labeling devices takes up the printed labels from the conveyor device and affixes them to a product.

8. The printing device of claim 1, wherein each of the label feed devices comprises:

a take-off reel for unrolling a ticket roll, wherein said ticket roll comprises a carrier strip and the labels which have been removably affixed to said carrier strip; and a take up reel for taking up the carrier strip from which the labels have been removed.

9. The printing device of claim 1, wherein each of the label feed devices comprises:

a supply device for accommodating tapes, wherein said tapes comprise the carrier strip and the labels which have been removably affixed thereto; and a take up device for taking up the carrier strip from which the labels have been removed.

10. The printing device of claim 1, wherein each of the label feed devices comprises a take-up device for taking up the carrier strip from which the labels have been removed, said take-up device comminuting, compressing or holding in interim storage the carrier strip from which the labels have been removed.

11. The printing device of claim 1, wherein the printer uses a printing process selected from the group consisting of thermal, thermotransfer, ink-jet, matrix and laser printing.

12. The printing device of claim 1, wherein at least two wiper heads are essentially arranged along a line.

13. The printing device of claim 1, wherein at least two wiper heads are essentially arranged along a reference circle path or a curved path.

14. The printing device of claim 1, wherein at least part of the label feed devices is arranged so as to be slidable essentially perpendicularly to the conveyor device.

* * * * *